US007416226B2

(12) United States Patent
Williams

(10) Patent No.: US 7,416,226 B2
(45) **Date of Patent: *Aug. 26, 2008**

(54) SPRING-BIASED PIN CONNECTION SYSTEM

(76) Inventor: John R. Williams, 4500 Williams Dr. #212-404, Georgetown, TX (US) 78628

( * ) Notice: Subject to any disclaimer, the term of this patent is extended or adjusted under 35 U.S.C. 154(b) by 0 days.

This patent is subject to a terminal disclaimer.

(21) Appl. No.: 11/810,205

(22) Filed: Jun. 4, 2007

(65) Prior Publication Data

US 2007/0262582 A1 Nov. 15, 2007

Related U.S. Application Data

(63) Continuation of application No. 10/829,924, filed on Apr. 22, 2004, now Pat. No. 7,243,958.

(51) Int. Cl.
*F16L 21/00* (2006.01)

(52) U.S. Cl. ..... 285/404; 285/317; 166/85.3

(58) Field of Classification Search ..... 285/404, 285/920, 317, 276; 166/85.3
See application file for complete search history.

(56) References Cited

U.S. PATENT DOCUMENTS 557,423 A * 3/1896 Outhouse et al. ..... 285/317
1,037,072 A * 8/1912 Snyder ..... 285/305
1,372,297 A * 3/1921 Kennedy ..... 285/317
3,796,448 A * 3/1974 Ringkamp ..... 285/317
4,606,557 A * 8/1986 Coffey ..... 285/317
4,743,079 A * 5/1988 Bloch ..... 285/404
5,348,107 A * 9/1994 Bailey et al. ..... 175/162
5,829,480 A * 11/1998 Smith, III ..... 285/317
6,230,824 B1 * 5/2001 Peterman et al. ..... 175/214
7,174,956 B2 * 2/2007 Williams et al. ..... 166/85.3
7,243,958 B2 * 7/2007 Williams ..... 285/404

* cited by examiner

*Primary Examiner*—David E Bochna
(74) *Attorney, Agent, or Firm*—David O. Simmons

(57) ABSTRACT

A system for connecting a stripper rubber to drilling head equipment comprises an adapter, a stripper rubber insert and a pin assembly. The adapter includes a primary bore, a groove extending around the primary bore, drill head equipment engaging structure adjacent the primary bore, and a pin assembly housing. The stripper rubber insert includes a vertically-upstanding flange configured for being engaged within the adapter groove. The flange includes a pin receptacle and the flange cooperatively mates with the adapter groove such that the pin receptacle is alignable with the pin assembly housing. The pin assembly is housed in the pin assembly housing of the adapter. The pin assembly includes a pin movably mounted for being selectively engagable with the pin receptacle for securing the stripper rubber insert to the adapter when the flange is engaged within the adapter groove with the pin receptacle suitably aligned with the pin.

20 Claims, 7 Drawing Sheets

SPRING-BIASED PIN CONNECTION SYSTEM

CROSS-REFERENCE TO RELATED APPLICATIONS

The present invention is a continuation of, and claims priority from, U.S. patent application Ser. No. 10/829,924, now U.S. Pat. No. 7,243,958, filed Apr. 22, 2004 by the present inventor, and entitled "Spring-Biased Pin Connection System".

FIELD OF THE INVENTION

The present invention relates to connectors and connector systems for making mechanical connections. More particularly, the invention provides apparatus, systems and methods for connecting or disconnecting a stripper rubber to or from equipment of a drilling head, such as the bearing assembly, to pressure-seal the interior of a well bore for the circulation, containment or diversion of drilling fluid through the well during drilling operations.

BACKGROUND OF THE INVENTION

Oil, gas, water and geothermal wells are typically drilled with a drill bit connected to a hollow drill string which is inserted into a well casing cemented in the well bore. A drilling head is attached to the well casing, wellhead or to associated blowout preventer equipment, for the purposes of sealing the interior of the well bore from the surface and facilitating forced circulation of drilling fluid through the well while drilling or diverting drilling fluids away from the well. Drilling fluids include, but are not limited to, water, steam, drilling muds, air, and other gases.

In the forward circulation drilling technique, drilling fluid is pumped downwardly through the bore of the hollow drill string, out the bottom of the hollow drill string and then upwardly through the annulus defined by the drill string and the interior of the well casing, or well bore, and subsequently out through a side outlet above the well head. In reverse circulation, a pump impels drilling fluid through a port, down the annulus between the drill string and the well casing, or well bore, and then upwardly through the bore of the hollow drill string and out of the well.

Drilling heads typically include a stationary body, often referred to as a bowl, which carries a rotatable spindle such as a bearing assembly, rotated by a kelly apparatus or top drive unit. One or more seals or packing elements, sometimes referred to as stripper packers or stripper rubbers, is carried by the spindle to seal the periphery of the kelly or the drive tube or sections of the drill pipe, whichever may be passing through the spindle and the stripper rubber, and thus confine or divert the pore pressure in the well to prevent the drilling fluid from escaping between the rotating spindle and the drilling string.

Rotating blowout preventers and diverters are well known to those of ordinary skill in the art of well pressure control. Rotation of the diverter/preventer is facilitated by a sealing engaged bearing assembly through which the drill string rotates relative to the stationary bowl or housing in which the bearing assembly is seated. Typically, a rubber o-ring seal, or similar seal, is disposed between the stripper rubber and the bearing assembly to improve the connection between the stripper rubber and the bearing assembly. Pressure control is achieved by means of one or more stripper rubbers connected to the bearing assembly and disposed around the drill string. At least one stripper rubber rotates with the drill string.

Stripper rubbers typically taper downward and include rubber or other resilient substrate so that the downhole pressure pushes up on the rubber, pressing the rubber against the drill string to achieve a fluid-tight seal. Stripper rubbers often further include metal inserts that provide support for bolts or other attachment means and which also provide a support structure to minimize deformation of the rubber cause by down hole pressure forces acting on the rubber.

Stripper rubbers are connected or adapted to equipment of the drilling head to establish and maintain the pressure control seal around a down hole tubular. It will be understood by those skilled in the art that a variety of means are used to attach a stripper rubber to the equipment above it. Such attachment means include bolting from the top, bolting from the bottom, screwing the stripper rubber directly onto the equipment via cooperating threaded portions on the top of the stripper rubber and the bottom of the equipment, and clamps.

It will also be understood that, depending on the particular equipment being used at a drilling head, a stripper rubber at one well may be connected to equipment specific to that well, while at another well a stripper rubber is connected to different equipment. For example, at one well the stripper rubber may be connected to the bearing assembly while at another well the stripper rubber may be connected to an inner barrel or an accessory of the drilling head. While the present invention is described here in relation to connecting the stripper rubber to the bearing assembly, it will be evident that the invention contemplates connection of the stripper rubber to any selected equipment of the drilling head.

It is common practice to tighten the bolts or screws of the connection with heavy wrenches and sledge hammers. The practice of using heavy tools to tighten a bolt, for example, can result in over-tightening, to the point where the threads or the bolt head become stripped. The results of over-tightening include stripped heads, where the bolt or screw cannot be removed, or stripped threads, where the bolt or screw has no grip and the connection fails. Both results are undesirable.

Even worse, vibration and other drilling stresses can cause bolts or screws to work themselves loose and fall out. If one or more falls downhole, the result can be catastrophic. The drill bit can be ruined. The entire drillstring may have to tripped out, and substantial portions replaced, including the drill bit. If the well bore has been cased, the casing may be damaged and have to be repaired.

Drilling head assemblies periodically need to be disassembled to replace stripper rubbers or other parts, lubricate moving elements, and perform other recommended maintenance. In some circumstances, stripped or over tightened bolts or screws make it very difficult if not impossible to disengage the stripper rubber from the drilling head assembly to perform recommended maintenance or parts replacement.

As modern wells are drilled ever deeper, or into certain geological formations, very high temperatures and pressures may be encountered at the drilling head. These rigorous drilling conditions pose increased risks to rig personnel from accidental scalding, burns or contamination by steam, hot water and hot, caustic well fluids. There is a danger of serious injury to rig workers when heavy tools are used to make a stripper rubber connection at the drilling head. The connection should be made quickly and achieve a fluid-tight seal.

It is desirable, therefore, to obtain a connector for optionally connecting a stripper rubber assembly to a bearing assembly, or other equipment, of a drilling head that is effective, safe, simple, fast and elegant.

BRIEF DESCRIPTION OF THE DRAWINGS

The present invention is further described in the detailed description that follows, by reference to the noted drawings, by way of non-limiting examples of embodiments of the present invention, in which like reference numerals represent similar parts throughout several views of the drawings, and in which.

DETAILED DESCRIPTION OF THE INVENTION

Figure 1:
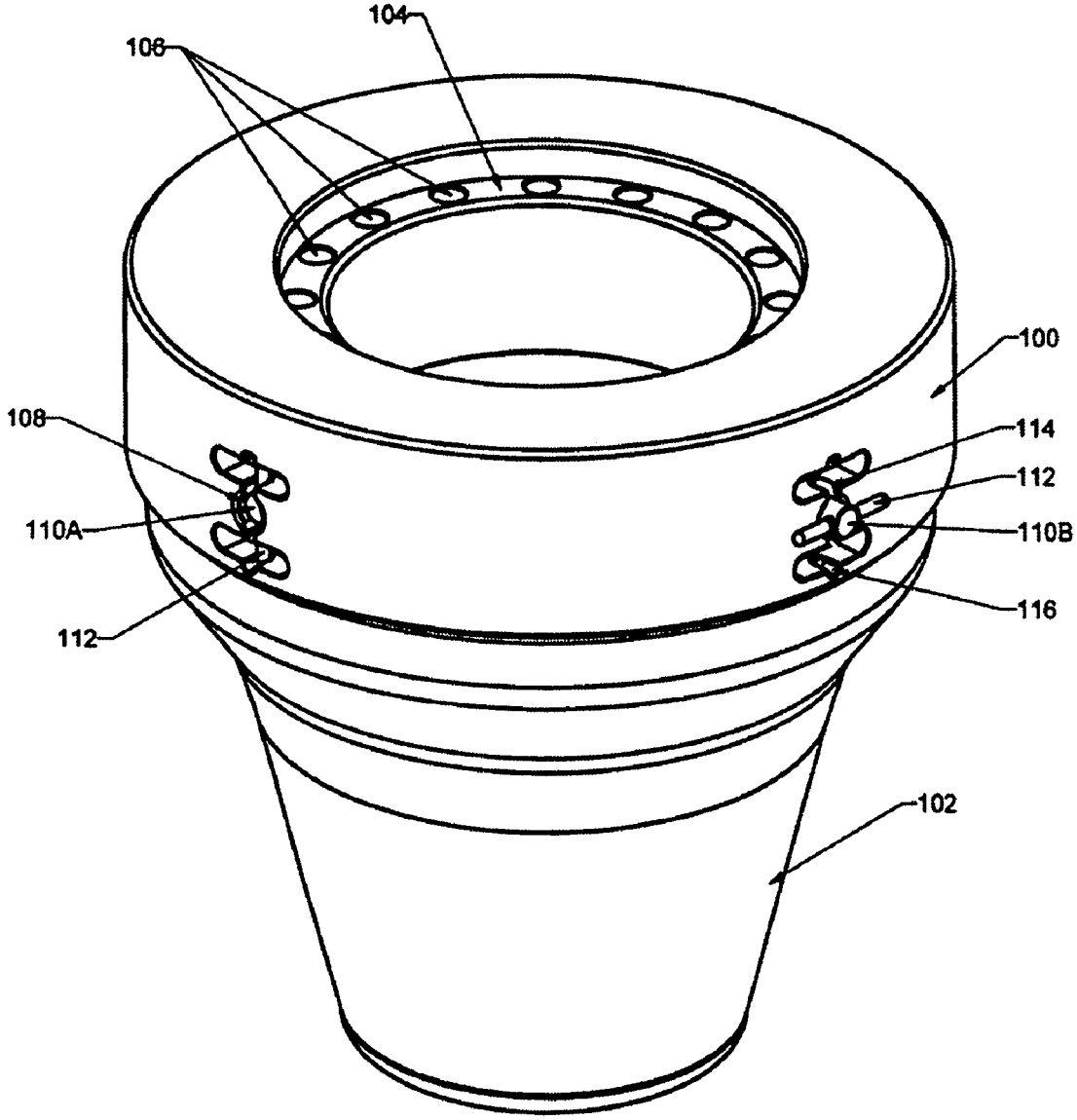
FIG. 1 is a side, isometric-view, schematic drawing of a connector system of one embodiment of the present invention.

In view of the foregoing, the present invention, through one or more of its various aspects, embodiments and/or specific features or sub-components, is thus intended to bring out one or more of the advantages that will be evident from the description. The present invention is described with frequent reference to stripper rubbers. It is understood, however, that a stripper rubber connector is merely an example of a specific embodiment of the present invention, which is directed generically to connectors and systems and methods for making connections within the scope of the invention. The terminology, examples, drawings and embodiments, therefore, are not intended to limit the scope of the invention.

Oil and gas wells are drilled with a drill bit attached to a hollow drill string which passes down through a well casing installed in the well bore. A drilling head attached to the top of the well casing, where it emerges from the ground, to seal the interior of the well casing from the surface, permits the forced circulation or diversion of drilling fluid or gas during drilling operations. In the forward circulation drilling mode, the drilling fluid or gas is pumped down through the interior of the hollow drill string, out the bottom thereof, and upward through the annulus between the exterior of the drill string and the interior of the well casing. In reverse circulation, the drilling fluid or gas is pumped down the annulus between the drill string and the well casing (or well bore) and then upward through the hollow drillstring.

Drilling heads often include a stationary body that carries a rotatable spindle such as a bearing assembly that is rotated by a kelly or top drive unit that drives the rotary drilling operation. A seal or packing, often referred to as a stripper rubber or packer, is carried by the spindle to seal the periphery of the kelly or the sections of drill pipe, whichever is passing through the spindle, and thereby confines the fluid pressure in the well bore and prevents the drilling fluid, whether liquid or gas, from escaping between the rotary spindle and the drill string.

Stripper packers provide rotational and slideable sealing of the drill string within the drilling head. The rotation of the kelly and drill string, the frequent upward and downward movement of the kelly and drill string during addition of drill pipe sections, and the high pressures to which the drilling head is subjected, demand that the consumable packing components of the drilling head be able to be quickly and securely replaced. As modern oil and gas wells go to greater depths having greater down hole bore pressures, ever more reliable means of sealing the drill string against release of internal drilling fluid pressure are sought.

The attachment of the stripper packer to the inner barrel of the drilling head is important in the containment or diversion of drilling fluid under bore hole pressure. Typically, the stripper packer includes an elongated generally cylindrical hard-rubber packer having an annular mounting collar secured to its upper end. The mounting collar of the packer, in turn, is secured onto the lower end of the spindle by any one of a variety of means, including bolting from the top, bolting from the bottom, screwing on with cooperating threaded potions or with a mounting clamp that is screwed or bolted tight for a positive mechanical interlock between the spindle mounting flange and the stripper rubber collar.

The art has not produced many viable alternatives to the above-described structures due, in part, to the difficulty of forming a suitable releasable yet reliable connection between a drilling head and a stripper rubber. This has been particularly true in those cases where the frictional engagement between the stripper rubber and the drill string provides the rotary driving force for the rotary spindle in the drilling head. In such instances, the stripper rubber is under constant torque loading and this tends to accelerate wear and ultimate failure of the rubber-to-spindle seal.

The present invention provides a stripper rubber connector system that eliminates the aforementioned bolts, screws, threads, and clamps, and which is selectively detachable from the drilling head. When assembled, a top ring, or adapter, of the present invention optionally bolts to the bottom of the spindle of the drilling head, and the stripper rubber connects to the top ring by the selectively lockable engagement of one or more spring-loaded pins or plungers. Additionally, seals such as o-rings, for example, which function between the stripper rubber and the adapter, effectively prevent pressurized fluids from leaking around the stripper rubber and compromising the fluid containment of the drilling head. The stripper rubber thereby maintains compressive engagement with the drillstring to provide a fluid-tight and pressure-tight seal therebetween, and supports the rotary torque loads transmitted via the stripper rubber from the rotating drill string to the rotary spindle.

Turning now to the drawings, FIG. 1 is a side, isometric view schematic drawing of a connector system of one embodiment of the present invention. The depicted embodiment is that of a stripper rubber. The stripper rubber embodiment provides top ring 100 and bottom stripper rubber 102. Annular shoulder 104 circumscribes the interior of top ring 100 and provides one or more mounting bores 106 disposed around shoulder 104 and extending therethough.

Mounting bores 106 facilitate the attachment of top ring 100 to an article of equipment, such as an inner barrel or bearing assembly of a drilling head. For example, top ring 100 may be bottom-bolted to the equipment by inserting bolts, through the bottom of top ring 100, which extend beyond shoulder 104 and threadedly connect to corresponding bores in the equipment. Alternative embodiments provide screws for mounting top ring 100, or top ring 100 may be threaded so as to screw on to the equipment directly. Those skilled in the art will appreciate a variety of means for mounting top ring 100 on to equipment.

Disposed around the side of top ring 100 are one or more plunger or pin assembly housings 108 that each receives a rotatable pin 110A/B (generically referred to herein from time to time as 110). The view provided by FIG. 1 depicts pin 110A in an engaged or locked position and pin 110B in a disengaged or unlocked position. Whether or not pin 110 is engaged or disengaged depends on the rotational orientation of pin handle 112.

Each pin assembly housing 108 provides slots 114 substantially on opposite sides of bore 108. Slots 114 cooperate with co-linear handle recesses 116 to accommodate handle 112 when pin 110A, for example, is in the engaged position.

Figure 2:
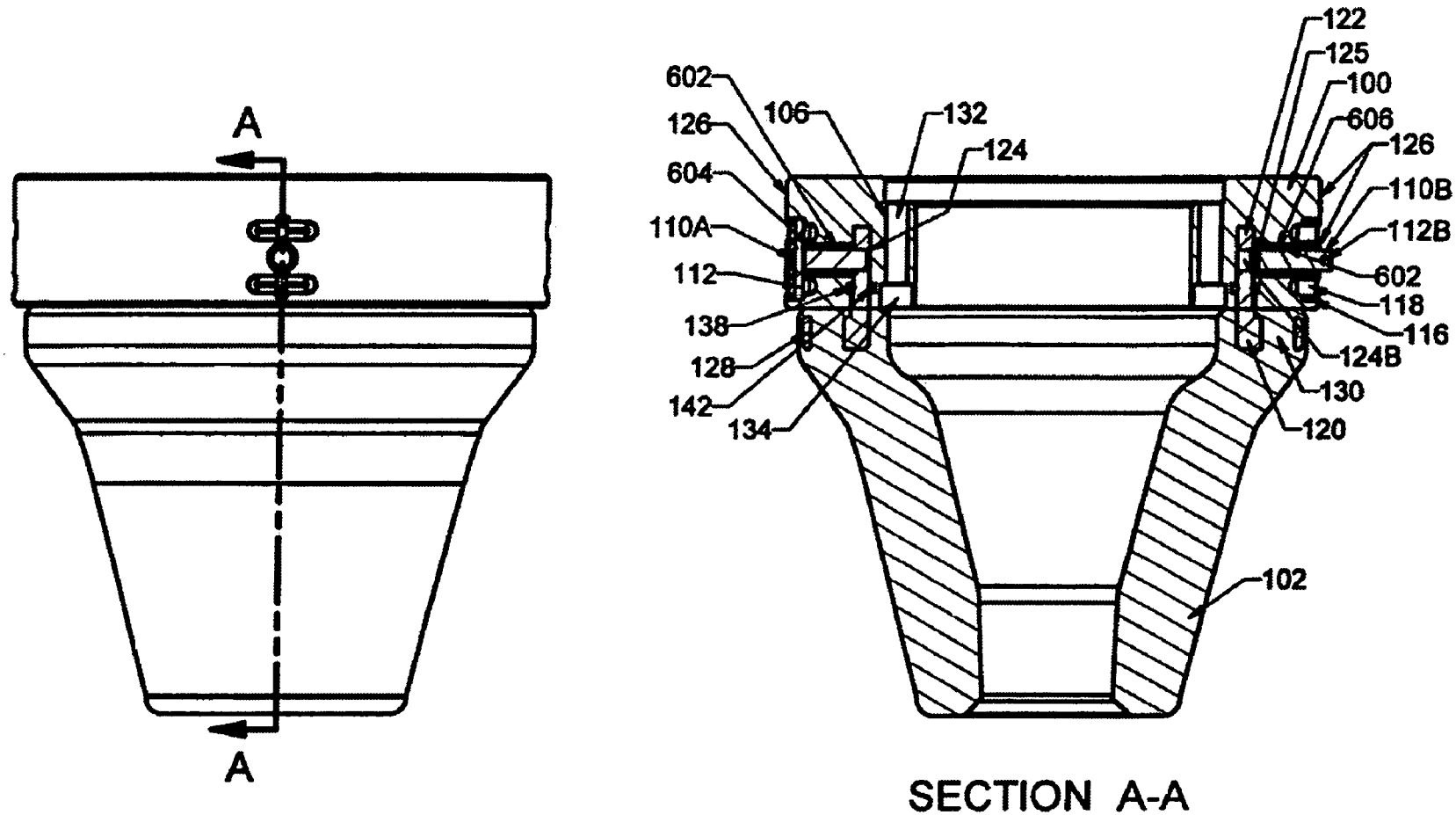
FIG. 2 is cross-section side view schematic drawing of the system of FIG. 1, bisected along line A-A.

FIG. 2 is cross-section side view schematic drawing of the system of FIG. 1, bisected along line A-A. Stripper rubber 102 is sealed against top ring 100. Mounting bores 106 extend axially through top ring 100 and provide bolt shaft housing 132, which may or may not be threaded, to retain a threaded bolt, and bold head receptacle 134. The recommended embodiment of bolt shaft housing 132 is to be unthreaded. Bolt head receptacle 134 serves as both a bolt stop and as a recess that receives the bolt head so that the bolt head is approximately flush with stripper rubber 102.

Insert 120 is at least partially embedded in stripper rubber 102 and disposed toward the top of stripper rubber 102, proximate to top ring 100. Insert shoulder 128 extends radially outward and is provided with a plurality of at least partial perforations 130, which enhance the strength of the bond between stripper rubber 102 and insert 120. Insert flange 122 extends axially upward out of stripper rubber 102 and is received by stripper rubber insert flange groove 140 (FIG. 4B) of top ring 100. One or more pin or plunger receptacles 124 are positioned around insert flange 122 so that each pin receptacle aligns with a corresponding pin assembly housing 108. Each pin receptacle 124 is adapted to receive and retain pin 110. In the embodiment depicted in FIG. 2, receptacle 124 consists of a lateral bore or hole, sized to fit pin 110. Alternative embodiments may provide pin receptacles or varying size, shape, depth or form.

One or more rubber o-rings, or other suitable sealing means, disposed within groove 140, enhance the seal between flange 122 and top ring 100. Annular or-ring housing 138, around the outer surface of the interior surface of groove 140, and o-ring housing 142, around the interior surface of groove 140, house rubber o-rings to provide a fluid-tight seal between top ring 100 and stripper rubber insert 120.

Turning now to the operation of pin assembly 600 (see FIG. 6) in pin assembly housing 108 (see FIG. 1), FIG. 2 shows pin 110A engaged with pin receptacle 124, and handle 112 resting in recesses 116 so as to be approximately flush with exterior side surface 126. Spring 602 is disposed around pin 110A in the annular space between the exterior surface of pin 110A and the interior surface of pin assembly sleeve 608. Flange 604 extends from the surface of sleeve 608 and acts as a spring stop. Spring 602 exerts force against flange 604, which biases pin 110A toward receptacle 124.

In contrast, pin 110B is disengaged from receptacle 124B. Handle 112B of pin 110B is oriented approximately perpendicular to handle 112 of pin 110A, so that handle 112B rests on surface 126, rather than being flush therewith. Pin flange 606 stops spring 602, which is disposed around pin 110B, and compresses spring 602 against bore flange 604. Comparison of spring 602 in position A and in position B reveals that spring 602 is relatively extended in position A and is relatively compressed in position B. Additionally, void 125 appears between pin 110B and receptacle 124B when pin 110 is in a disengaged position.

To selectively change pin 110 from an engaged to a disengaged position, an operator simply slides his or her fingers in finger recesses 118, which provide sufficient clearance between handle 112A (in handle recesses 116) and the bottom of finger recesses 118 to accommodate the operator's fingers. The operator grasps handle 112A and pulls outward, compressing spring 602, until pin 110 clears receptacle 124 and withdraws into bore 108. The operator then rotates handle 112 obliquely to slots 114 and 116. Upon letting go of handle 112, spring 602 biases pin 110 so that handle 112 rests on surface 126 in a disengaged position and pin 110 is clear of insert flange 122. When all pins 110 are in a disengaged position, stripper rubber 102 slides off or out of top ring 100 with relative ease.

Figure 3A:
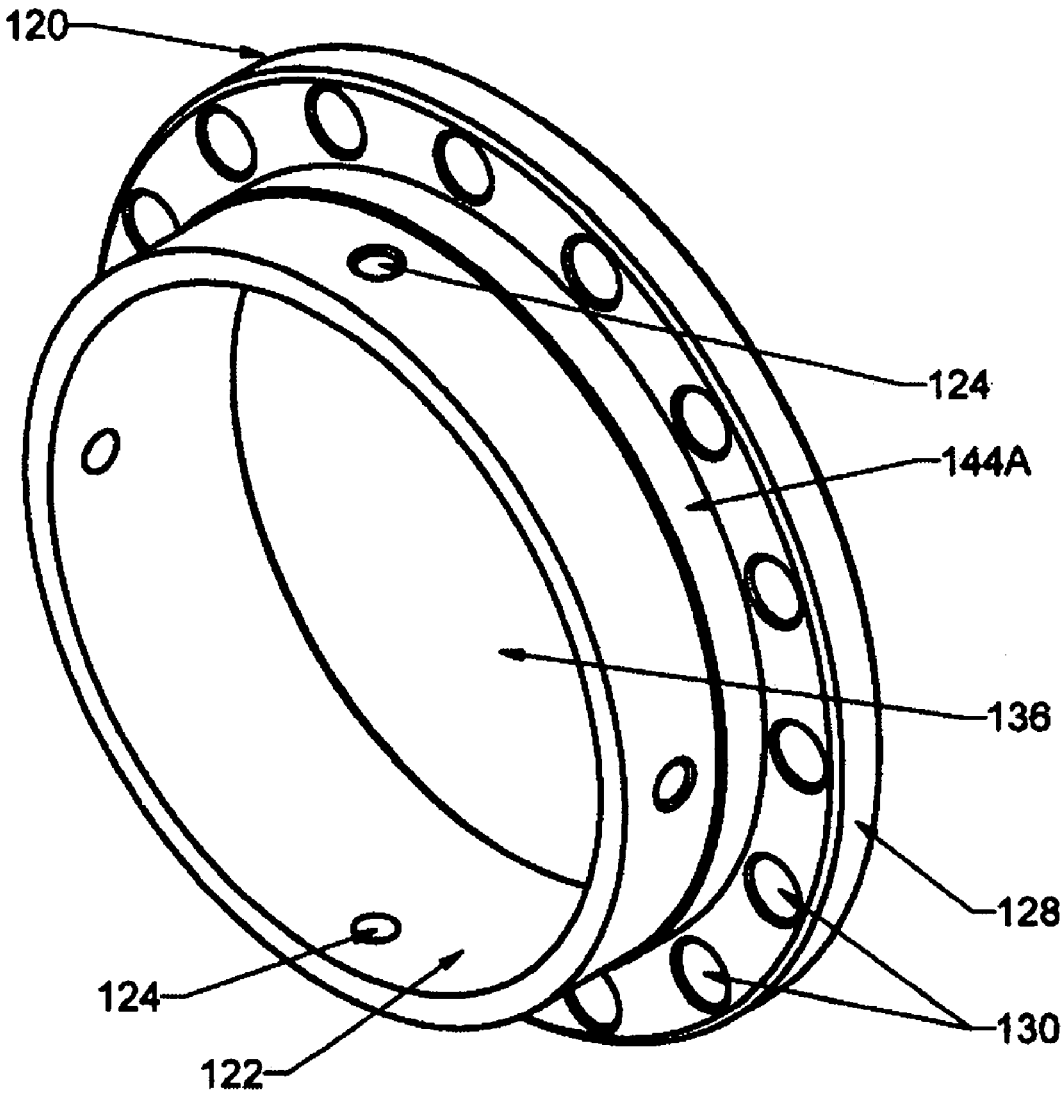
FIG. 3A is an isometric-view schematic drawing of a stripper rubber insert of one embodiment of the present invention.

FIG. 3A is an isometric-view schematic drawing of stripper rubber insert 120 of one embodiment of the present invention. During manufacture of stripper rubber 102, a substantially elastomeric material is in a fluid state so that the material flows through perforations 130. Upon curing, the fluid elastomeric material partially hardens to form an at least partially resilient sealing element—the "rubber" of the stripper rubber. The elastomeric material partially hardens around the insert 120 and through perforations 130 to substantially embed shoulder 128 in the resilient sealing element. One or more axial perforations 130, disposed around shoulder 128, are recommended to enhance the mechanical bond between insert 120 and the stripper rubber's resilient substrate. Bonding agents may also be used during manufacture to further enhance the bond between the insert and the rubber.

Insert flange 122 extends upward from insert shoulder 128, which is at least partially embedded in the resilient sealing substrate (not shown) of stripper rubber 102. Shoulder 128 and flange 122 cooperatively define primary bore 136.

Flange 122 extends out of the resilient substrate. At least one of substantially lateral pin receptacle bores 124, adapted to receive a pin 110, is positioned around flange 122 to align with at least one pin assembly housing 108 of top ring 100. Seal boss 144A of flange 122 is formed where the transverse width of the upper portion of flange 122 is narrower than the width of the lower portion (proximate to shoulder 128). An o-ring or other suitable sealing element seats around seal boss 144A to enhance the fluid-tight seal between insert 122 and top ring 100.

Figure 3B:
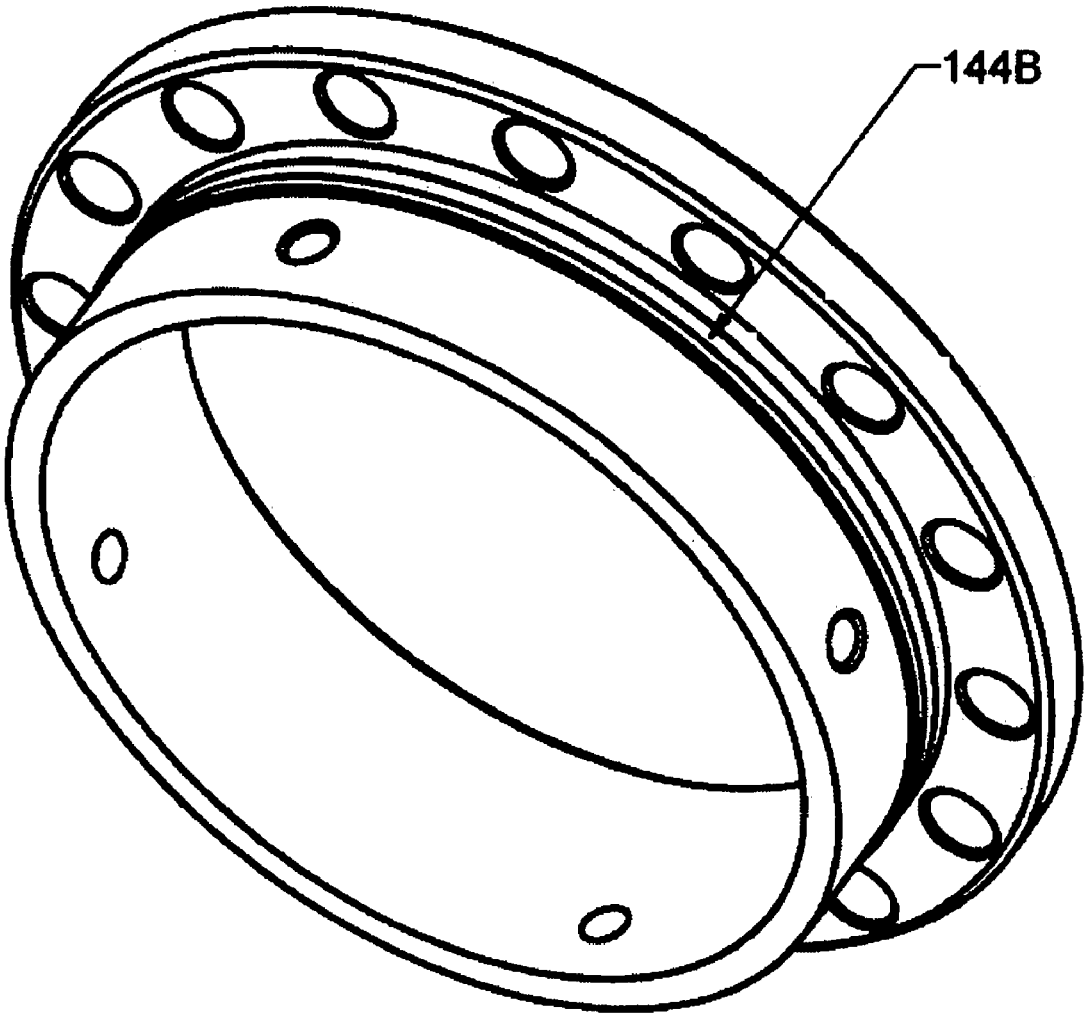
FIG. 3B is an isometric-view schematic drawing of an alternative embodiment of a stripper rubber insert of FIG. 3A.

FIG. 3B depicts an alternative embodiment of the insert of FIG. 3A. The seal boss provides one or more o-ring groove 144B to retain a sealing element, such as a rubber o-ring (not shown), that seals flange 122 against the walls of flange receptacle 140 in top ring 100. See the discussion, below, of FIG. 4B to understand the sealing engagement of the insert 120 of FIG. 3B with top ring 100. One or more sealing elements between insert 120 and top ring 100 achieve a fluid-tight seal for effective performance of the invention.

Figure 4:
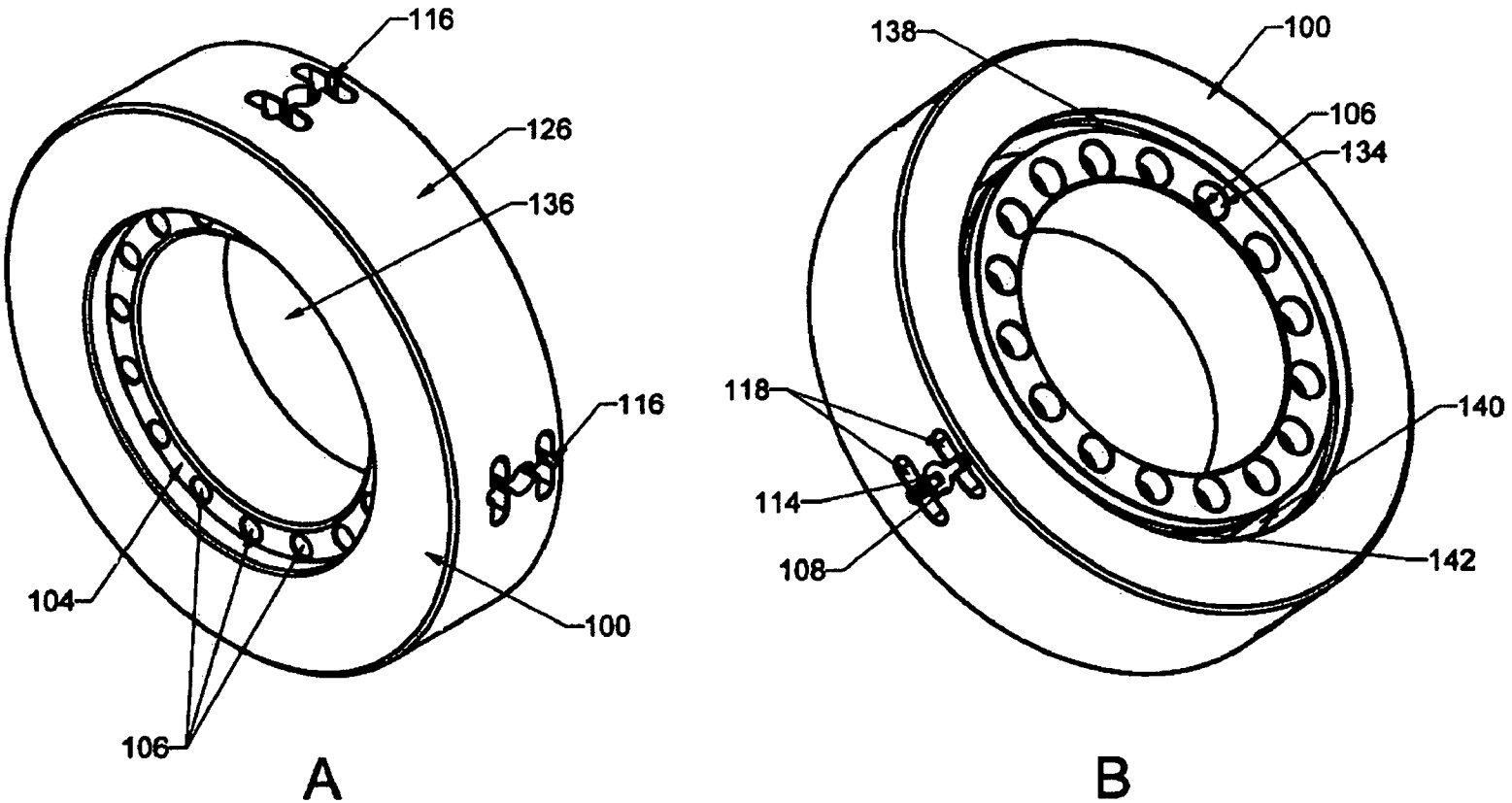
FIG. 4A is a top, isometric-view, schematic drawing of a top ring of the embodiment of FIG. 1.
FIG. 4B is a bottom, isometric-view, schematic drawing of the top ring of FIG. 4A.

FIG. 4A is an isometric top view schematic drawing of top ring 100 of the embodiment of FIG. 1. Annular shoulder 104 provides at least one mounting bore 106 for mounting top ring 100 to a piece of equipment such as a drilling head bearing assembly or inner barrel. Pin handle recesses 116 are adapted to accommodate pin handle 122 (not shown) so that handle 122 rests substantially flush with side surface 126.

FIG. 4B is an isometric bottom view schematic drawing of top ring 100 of FIG. 4A. A plurality of mounting bores 106 each provide bolt head receptacle 134 to receive the head of a bolt, screw, or other fastener, used to bottom-bolt top ring 100 to a piece of equipment.

Top ring 100 may be considered and adapter or collet to receive and retain flange 122 of stripper rubber insert 120. Flange receptacle 140 provides a concentric groove or recess adapted to fit insert flange 122 of stripper rubber 102 (see FIG. 2). Receptacle 140 is adapted to receive insert flange 122. O-ring grooves 138 and 142 circumscribe the outer and inner the surfaces, respectively, of receptacle 140 to seat rubber o-rings, or other suitable sealing members, to enhance the fluid-tight seal between top ring 100 and insert flange 122. In the case of the embodiment of FIG. 3B, groove 138 is replaced by groove 144B on insert 120 to obtain the fluid tight seal by cooperative sealing engagement of top ring 100 and insert flange 122.

Traversing laterally through top ring 100, is at least one pin assembly housing 108, which is adapted to receive pin 110. Pin assembly housing 108 extends to, and opens into, flange receptacle 140, but does not extend to shoulder 104. Bore 108 provides slots 114 and recesses 116 to receive pin handle 112 in the engaged position. Opposite each other across bore 108 are finger receptacles 118, which accommodate the fingers of an operator to facilitate pulling pin 110 into the disengaged position.

Figure 5:
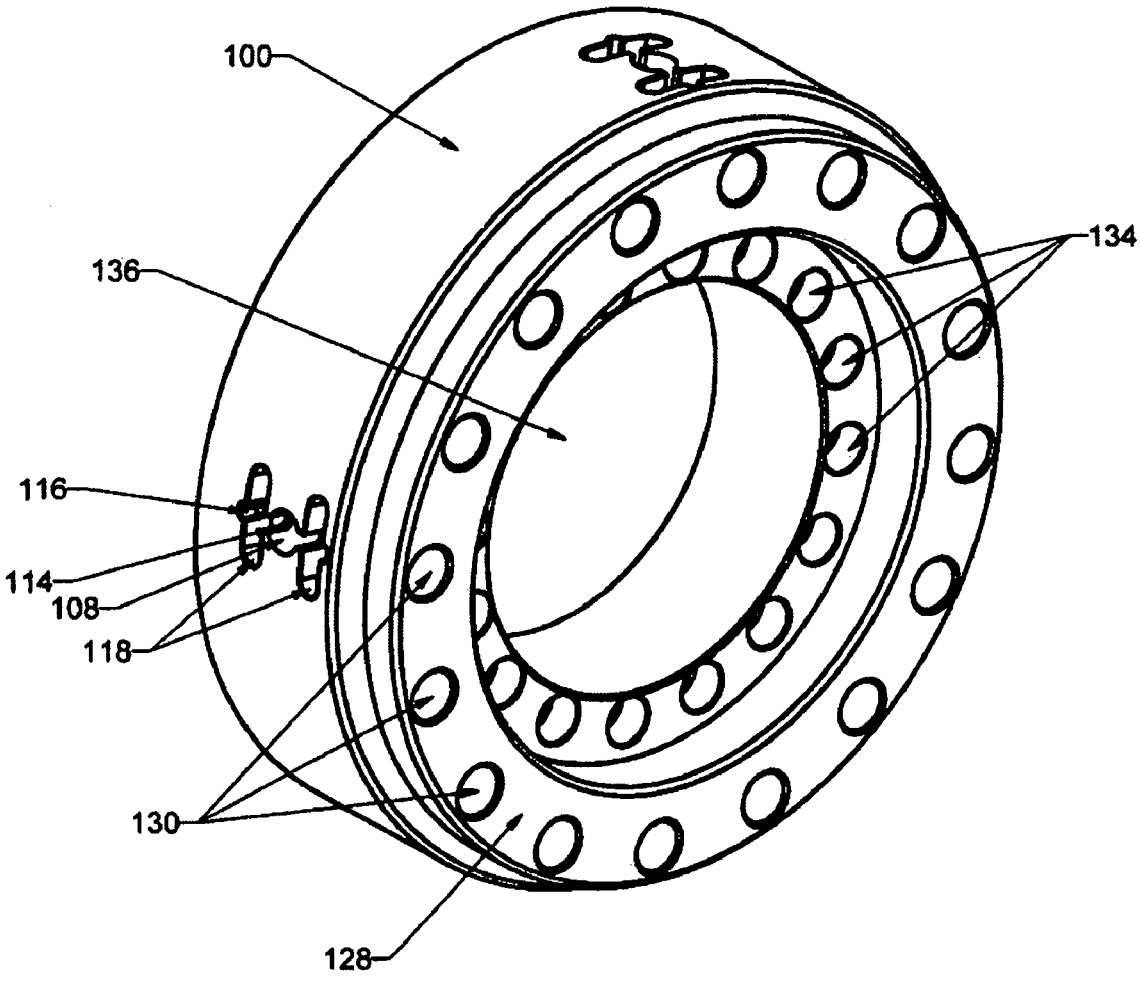
FIG. 5 is an isometric bottom view schematic drawing of a connector system of the present invention, omitting the resilient substrate of the stripper rubber, and assembled but for the pin assemblies.
Figure 6:
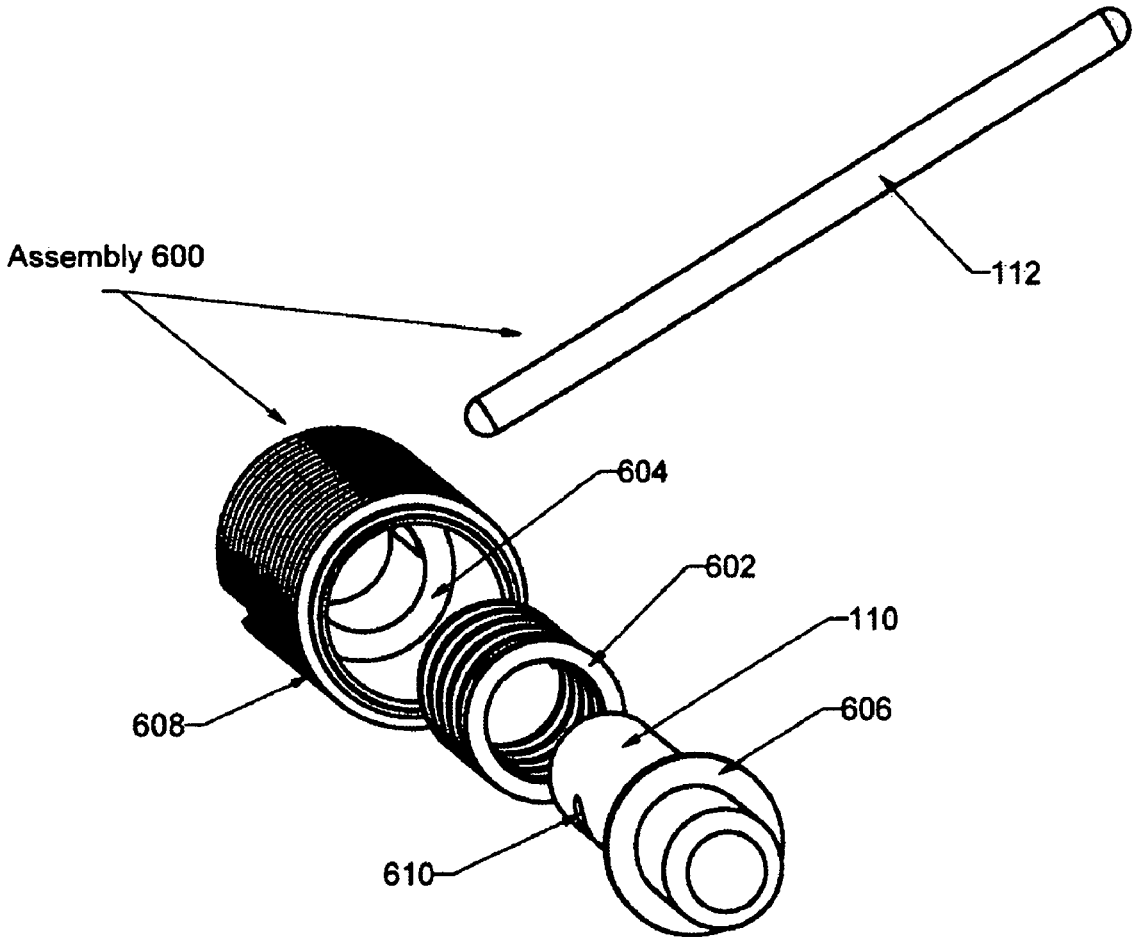
FIG. 6 is an exploded, isometric-view schematic drawing of a retention pin assembly one embodiment of the present invention.

FIG. 5 is an isometric, bottom-view schematic drawing of a connector system of the present invention, omitting the resilient substrate of stripper rubber 102, and assembled but for the pin assemblies (see FIG. 6). Top ring 100 defines primary bore 136, which extends axially through the interior void of ring 100 to receive a drillstring or tool. A portion of mounting bores 106, specifically bolt head receptacles 134, can be seen in this view. From the perspective of this FIG. 5, one can see that, when top ring 100 is seated on insert 128, ring 100 extends radially inward of primary bore 136, so that mounting bores 106 are clear of stripper rubber insert 128 to receive mounting bolts (not shown).

Concentrically around top ring 100 is insert shoulder 128 having perforations 130 to enhance the bond between insert 120 and the resilient substrate (not shown), such as rubber, of stripper rubber 102. One or more pin assembly housings 108 perforate top ring 100 substantially perpendicularly to primary bore 136, and extend to, and aligned with, pin receptacles 124 disposed around insert flange 122 seated in flange receptacle 140 of top ring 100. Insert flange 122, insert flange receptacle 140, and pin receptacles 124 are obscured in the view of this FIG. 5. As described above, top ring 100 further provides slots 114, finger recesses 118, and handle recesses 116.

FIG. 6 is an exploded view schematic drawing of spring-biased pin assembly 600 of one embodiment of the present invention. Pin 110 provides pin flange 606, which stops spring 602. Pin 110 is rotatably disposed within pin insert or sleeve 608. Sleeve 608 may provide external threads so that sleeve 608 may be screwed into pin assembly housing 108 of top ring 100. Pin 110 extends out of the distal end of insert 608 so that pin handle bore 610 is exposed and pin handle 112 can be inserted through bore 610.

Spring 602 is disposed around pin 110 in the annular space between pin 110 and sleeve 608 and between sleeve flange 604 and pin flange 606. Spring 602 is compressed between pin flange 606 and sleeve flange 604 within insert 608 to provide a bias that impels pin 110 perpendicularly to primary bore 136 and toward pin receptacle 124.

The entire pin assembly 600 is inserted within pin assembly housing 108 of top ring 100. Top ring 100 is mounted on stripper rubber 102 so that pin assembly housings 108 align with corresponding pin receptacles 124. Pin handle 112 may then be rotated by an operator so that pin handle 112 aligns with slots 114. Letting go of handle 112 partially releases compressed spring 602 to push pin 110 toward pin receptacle 124 so that the proximate end of pin 110 is received by pin receptacle 124 and secured in position by compression forces from spring 602.

The connector system of the present invention provides a spring-loaded pin-type connection between an article of drilling head equipment and a stripper rubber. More generically, however, the present invention provides a system for circular connections, such as connecting tubes together, connecting a tool to a tube, connecting a tube to a flange or for connecting a tool to a flange. The combination of the top ring or adapter with the stripper rubber insert, of the stripper rubber embodiment described above as a mere example of a connection system of the present invention, is easily generalized by those of ordinary skill in the art to a wide variety of mechanical connection applications, including but not limited to those identified above.

The present invention further provides a connection system for connecting parts of an apparatus. A first part having one or more pin receptacles cooperatively mates to a second part having one or more spring-biased pin assemblies. The second part further provides one or more pin assembly housings. The first and second parts assemble such that at least one pin assembly housing aligns with at least one pin receptacle. At least one pin assembly disposed through the at least one pin assembly housing selectively engages the pin receptacle to secure the connection of the first part to the second part of the apparatus.

Each pin assembly may include a pin assembly sleeve having a spring stop; a spring seated within the sleeve; a pin, also having a spring stop, rotatably disposed through the spring, and a removable pin handle connected to the pin distally from the pin spring stop. The pin selectively engages the retention pin receptacle with a spring-loaded bias to secure the connection of the first part to the second part of the apparatus.

An alternative embodiment of the pin assembly provides a spring-biased pin assembly with a pin assembly sleeve having a distal spring stop, and also having at least one slot to receive a pin handle. A spring seated within the sleeve has axially disposed through it an at least partially rotatable pin that has a proximate spring stop. A pin handle connected to the pin distally from the pin spring stop operates so that the handle is selectively disposable in and withdrawable from the slot of the sleeve to selectively extend the pin at least partially out of, or retract the pin at least partially into, the sleeve.

The first part of the apparatus may be, for example, drilling head equipment, such as an inner barrel or a bearing assembly. Alternatively, the first part may be a connection adapter, such as the top ring described above, that provides means for connecting the adapter to a part of the apparatus and also provides the connector system of the present invention to connect the adapter to another part of the apparatus. Whether the first part is an article of equipment or an adapter, or something else, the first part, generally speaking, is a collet that receives a flange, or extension, of the second part.

The second part may be a stripper rubber, which typically includes an insert that provides means for connecting the rubber to a piece of drilling head equipment such as an inner barrel or a bearing assembly. The insert provides one more receptacles to receive one or more biased retaining pin to secure the connection between the parts.

In some embodiments of the present invention, the top ring serves as an adapter to facilitate the connection between the stripper rubber and drilling head equipment such as, for example, a bearing assembly. In certain contexts, however, the drilling head equipment includes the adapter (or top ring)

itself, such that the stripper rubber insert couples with the adapter. In such instances, the adapter (or "equipment") is further adapted to connect to a third part of the apparatus, such as the inner barrel of a drilling head.

Particular embodiments of the present invention provide an assembly for connecting a stripper rubber to drilling head equipment. The assembly includes, but is not limited to, an adapter that is connectable to the stripper rubber, and means for connecting the adapter to the drilling head equipment. The adapter further provides one or more pin assembly housings to receive at least one spring-biased pin assembly. A stripper rubber having one or more pin receptacles, cooperatively mates with the adapter such that at least one pin assembly housing aligns with at least one pin receptacle. At least one pin assembly, disposed through the at least one pin assembly housing, selectively engages the pin receptacle to secure the connection of the adapter to the stripper rubber.

Additionally, the present invention provides an adapter for connecting parts of an apparatus. The adapter includes means for connecting the adapter to a first part of the apparatus. Such means include, for example, bores parallel to the primary bore and disposed through the adapter to receive bolts or screws so that the adapter can be bolted onto the apparatus. The adapter provides one or more pin assembly housings that are adapted receive a spring-biased pin assembly.

The present invention yet further provides a stripper rubber insert adapted to seat an adapter of the present invention and to receive and secure one or more spring-biased pins. Inserts are commonly made of metal, but other materials, such as composite, synthetic, or hardened resin materials, may provide comparable functionality. Likewise, the components of the pin assembly and the top ring or adapter may be composed of metal, composite, synthetic, or hardened resin, or any suitable material to obtain the desired function.

The present invention contemplates that operation of the described connector system may be performed automatically and be remotely controlled. Remote control may be implemented by hydraulic, pneumatic or electronic means that selectively cause the one or more pins to be in an engaged or disengaged position. Electronic automatic operation may be accomplished, for example, by a programmable microprocessor to control motors connected to the pin assemblies.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A system for connecting a stripper rubber to drilling head equipment, the system comprising:

an adapter including a primary bore, a groove extending around the primary bore, drill head equipment engaging structure adjacent the primary bore, and a pin assembly housing, wherein the drill head equipment engaging structure is configured for being engaged with a mating portion of said drilling head equipment for attaching the adapter to said drilling head equipment;

a stripper rubber insert including a vertically-upstanding flange configured for being engaged within said adapter groove, wherein said flange includes a pin receptacle and wherein the flange cooperatively mates with said adapter groove such that the pin receptacle is alignable with the pin assembly housing; and a pin assembly housed in the pin assembly housing of the adapter, wherein the pin assembly includes a pin movably mounted for being selectively engagable with the pin receptacle for securing the stripper rubber insert to the adapter when said flange is engaged within said adapter groove with the pin receptacle suitably aligned with the pin.

2. The system of claim 1 wherein:

said adapter groove is generally circular and is generally concentric to the primary bore; and said flange is generally circular.

3. The system of claim 1 wherein:

a seal-receiving groove is provided in at least one of a side surface of said flange and a side surface of said adapter groove; and the seal-receiving groove is configured for receiving a sealing member to form a sealing interface between said flange and said adapter groove when said flange is engaged within said adapter groove.

4. The system of claim 3 wherein:

said adapter groove is generally circular and is generally concentric to the primary bore; and said flange is generally circular.

5. The system of claim 1 wherein the pin is forcibly biased to a flange engaging position.

6. The system of claim 5 wherein:

the pin assembly housing includes a pin assembly bore, a pin handle receptacle that intersects the pin assembly bore and a finger receptacle that intersects the pin handle receptacle;

the pin is translatably and rotatably mounted within the pin assembly bore;

the pin assembly includes a handle attached to the pin;

the handle, the pin and the pin assembly housing are jointly configured such that the handle is positioned within the pin handle receptacle when the pin is in the flange engaging position; and the handle is accessible through the finger receptacle when the pin is in the flange engaging position for allowing the handle to be grasped when the pin is in the flange engaging position.

7. The system of claim 6 wherein:

said adapter groove is generally circular and is generally concentric to the primary bore; and said flange is generally circular.

8. The system of claim 7 wherein:

a seal-receiving groove is provided in at least one of a side surface of said flange and a side surface of said adapter groove; and the seal-receiving groove is configured for receiving a sealing member to form a sealing interface between said flange and said adapter groove when said flange is engaged within said adapter groove.

9. A stripper rubber configured for being engaged with a stripper rubber adapter unit having a primary bore generally concentric with a flange-receiving groove thereof and having drill head equipment engaging structure adjacent the primary bore for allowing the stripper rubber adapter unit to be engaged with a mating portion of said drilling head equipment, wherein the stripper rubber adapter unit includes a pin assembly configured for securing the stripper rubber thereto, the stripper rubber comprising:

a stripper rubber body; and a stripper rubber insert within the stripper rubber body and including a vertically-upstanding flange extending from the stripper rubber body, wherein said flange is configured for being engaged within the flange-receiving groove of the stripper rubber adapter unit, wherein said flange cooperatively mates with the flange-receiving groove such that a pin receptacle of the stripper rubber insert is alignable with a pin of the pin assembly for allowing the pin to be selectively engaged within the pin receptacle to secure the stripper rubber insert to the stripper rubber adapter unit when the flange is engaged within the flange-receiving groove with the pin receptacle suitably aligned with the pin.

10. The stripper rubber of claim 9 wherein said flange is generally circular.

11. The stripper rubber of claim 9 wherein:

a seal-receiving groove is provided in a side surface of said flange; and the seal-receiving groove is configured for receiving a sealing member to form a sealing interface between said flange and said adapter groove when said flange is engaged within said adapter groove.

12. The stripper rubber of claim 11 wherein said flange is generally circular.

13. A stripper rubber adapter configured for being engaged with a stripper rubber having a stripper rubber insert within a stripper rubber body thereof and having a vertically upstanding flange extending from within the stripper rubber body, the stripper rubber adapter comprising:

an adapter including a primary bore, a groove extending around the primary bore, drill head equipment engaging structure adjacent the primary bore, and a pin assembly housing, wherein the drill head equipment engaging structure is configured for being engaged with a mating portion of said drilling head equipment for attaching the adapter to said drilling head equipment; and a pin assembly housed in the pin assembly housing, wherein the pin assembly includes a pin movably mounted for being selectively engagable with the pin receptacle of said stripper rubber insert flange for securing the stripper rubber insert to the adapter when said stripper rubber insert flange is engaged within said adapter groove with the pin receptacle suitably aligned with the pin.

14. The adapter of claim 13 wherein said adapter groove is generally circular and is generally concentric to the primary bore.

15. The adapter of claim 13 wherein:

a seal-receiving groove is provided in a side surface of said adapter groove; and the seal-receiving groove is configured for receiving a sealing member to form a sealing interface between said flange and said adapter groove when said flange is engaged within said adapter groove.

16. The adapter of claim 15 wherein said adapter groove is generally circular and is generally concentric to the primary bore.

17. The adapter of claim 13 wherein the pin is forcibly biased to a flange engaging position.

18. The adapter of claim 17 wherein:

the pin assembly housing includes a pin assembly bore, a pin handle receptacle that intersects the pin assembly bore and a finger receptacle that intersects the pin handle receptacle;

the pin is translatably and rotatably mounted within the pin assembly bore;

the pin assembly includes a handle attached to the pin;

the handle, the pin and the pin assembly housing are jointly configured such that the handle is positioned within the pin handle receptacle when the pin is in the flange engaging position; and the handle is accessible through the finger receptacle when the pin is in the flange engaging position for allowing the handle to be grasped when the pin is in the flange engaging position.

19. The adapter of claim 18 wherein said adapter groove is generally circular and is generally concentric to the primary bore.

20. The adapter of claim 19 wherein:

a seal-receiving groove is provided in a side surface of said adapter groove; and the seal-receiving groove is configured for receiving a sealing member to form a sealing interface between said flange and said adapter groove when said flange is engaged within said adapter groove.

* * * * *